US009661967B2

(12) United States Patent
Middleton

(10) Patent No.: US 9,661,967 B2
(45) Date of Patent: May 30, 2017

(54) VACUUM ATTACHMENT FOR CLEANING FACILITY SPRINKLER HEADS

(71) Applicant: James Austin Middleton, Elk Grove, CA (US)

(72) Inventor: James Austin Middleton, Elk Grove, CA (US)

( * ) Notice: Subject to any disclaimer, the term of this patent is extended or adjusted under 35 U.S.C. 154(b) by 337 days.

(21) Appl. No.: 14/567,779

(22) Filed: Dec. 11, 2014

(65) Prior Publication Data

US 2016/0166123 A1 Jun. 16, 2016

(51) Int. Cl.
*A47L 9/02* (2006.01)
*A47L 9/24* (2006.01)

(52) U.S. Cl.
CPC ..... *A47L 9/02* (2013.01); *A47L 9/242* (2013.01); *A47L 9/248* (2013.01)

(58) Field of Classification Search
CPC ..... A47L 9/02; A47L 9/242; A47L 9/248
USPC ..... 15/415.1
See application file for complete search history.

(56) References Cited

U.S. PATENT DOCUMENTS

2003/0079309 A1* 5/2003 Vandenbelt ..... A47L 7/0057 15/246.2

* cited by examiner

*Primary Examiner* — David Redding
(74) *Attorney, Agent, or Firm* — Plager Schack LLP

(57) ABSTRACT

Some embodiments of the present disclosure include a vacuum attachment for cleaning sprinkler heads. The vacuum attachment may include a cleaning extension head having a hollow upper head tube tapering to a hollow lower head tube, wherein the upper head tube has a larger diameter than the lower head tube. The upper head tube may have an upper head tube opening configured to accommodate a facility sprinkler, and the lower head tube may be configured to accommodate a vacuum hose, such that the vacuum hose is configured to removably attach to the cleaning extension head. In some embodiments, the attachment may also include a universal extension device to help users reach sprinklers on higher ceilings.

11 Claims, 4 Drawing Sheets

VACUUM ATTACHMENT FOR CLEANING FACILITY SPRINKLER HEADS

BACKGROUND

The embodiments herein relate generally to janitorial services, and more particularly, to a vacuum attachment for cleaning facility sprinkler heads.

Facility sprinkler heads often get covered in dust and cobwebs. The National Fire Protection Association (NFPA) requires sprinkler heads to be cleaned, as they can load with material. However, the sprinkler head is very delicate due to the glass bulb inside that is designed to burst and activate at certain temperatures.

Currently, suggested cleaning methods include using a vacuum, compressed air, or canned air. However, there is no safe design that precludes a normal vacuum attachment from striking the sprinkler head's glass bulb. Additionally, problems exist with using the wrong level of air pressure via a compressor or temperature of air as which the propellant in a can. All of these issues can cause the glass bulb in the sprinkler head to break, which activates the fire suppression system and could potentially flood a room or facility.

Therefore, what is needed is a vacuum attachment for cleaning a facility sprinkler head that decreases the likelihood of the sprinkler bulb being broken.

SUMMARY

Some embodiments of the present disclosure include a vacuum attachment for cleaning sprinkler heads. The vacuum attachment may include a cleaning extension head having a hollow upper head tube tapering to a hollow lower head tube, wherein the upper head tube has a larger diameter than the lower head tube. The upper head tube may have an upper head tube opening configured to accommodate a facility sprinkler, and the lower head tube may be configured to accommodate a vacuum hose, such that the vacuum hose is configured to removably attach to the cleaning extension head. In some embodiments, the attachment may also include a universal extension device to help users reach sprinklers on higher ceilings.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
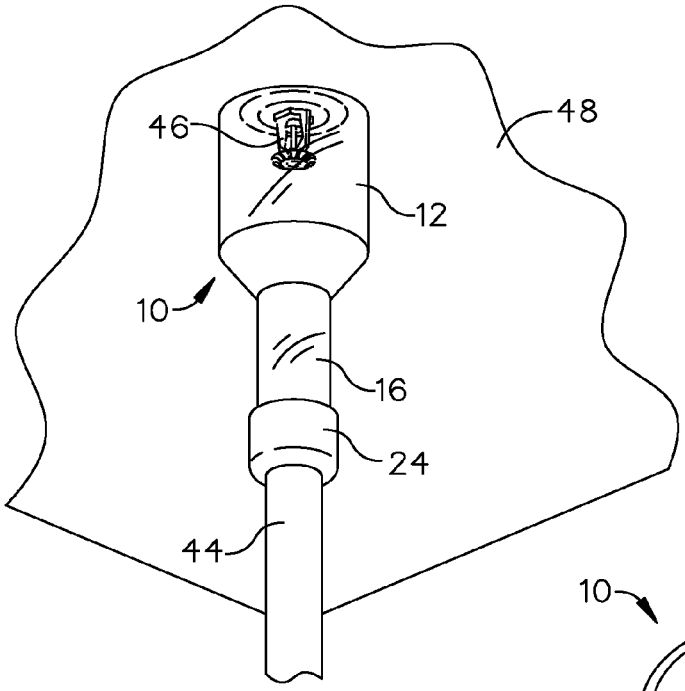
FIG. 1 is a bottom perspective view of one embodiment of the present invention, shown in use.
Figure 2:
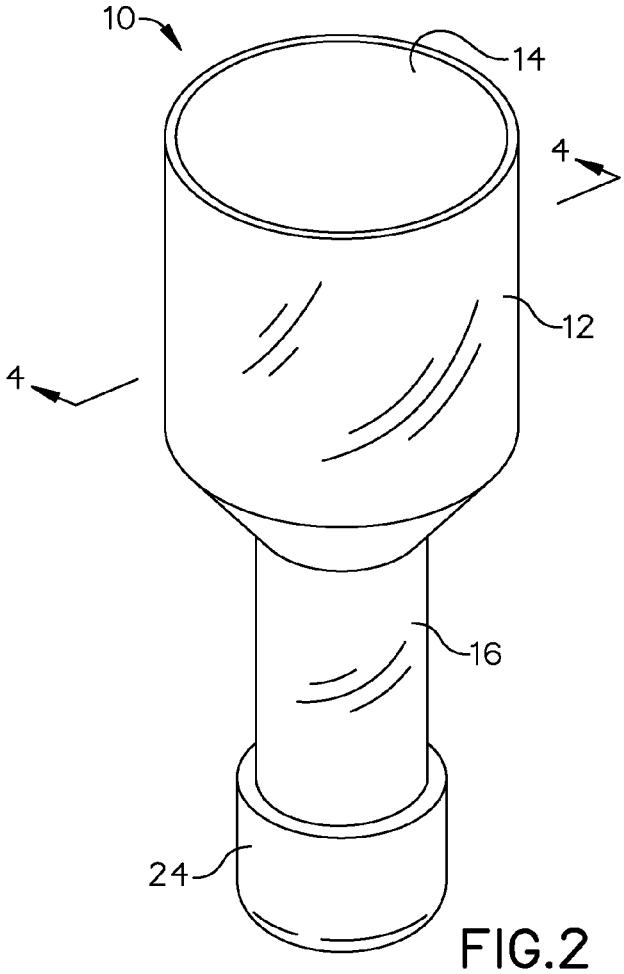
FIG. 2 is a perspective view of one embodiment of the present invention.
Figure 3:
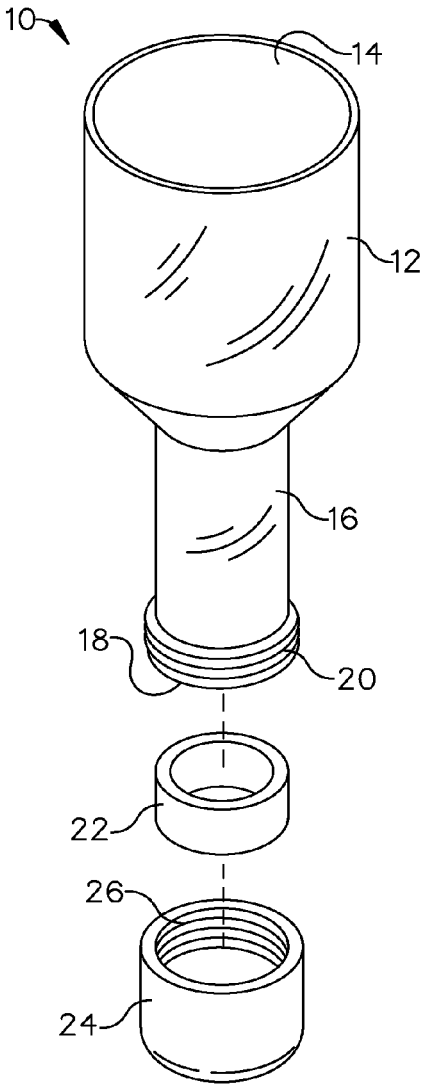
FIG. 3 is an exploded view of one embodiment of the present invention.
Figure 4:
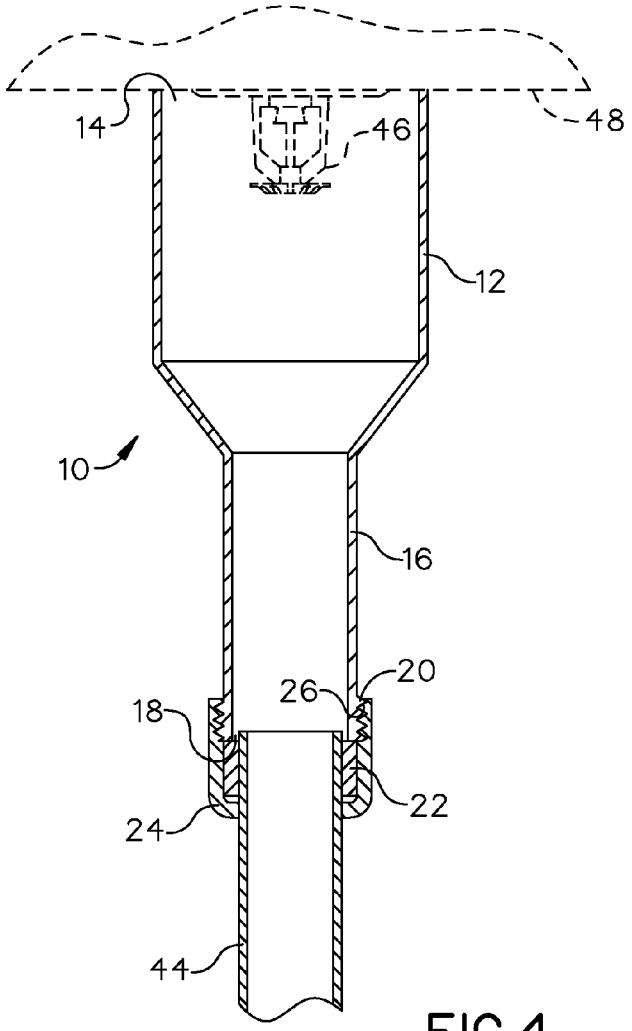
FIG. 4 is a section view of one embodiment of the present invention, taken along line 4-4 in FIG. 2.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to clean a facility sprinkler head and may comprise the following elements: a cleaning extension head and a cap. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the vacuum attachment for cleaning facility sprinkler heads of the present disclosure may be related in the following exemplary fashion. It is not intended to limit the scope or nature of the relationships between the various elements and the following examples are presented as illustrative examples only.

By way of example, and referring to FIGS. 1-9, some embodiments of the vacuum attachment of the present disclosure comprise a cleaning extension head 10 comprising a hollow upper head tube 12 tapering to a hollow lower head tube 16 wherein the upper head tube 12 has a larger diameter than the lower head tube 16 the upper head tube 12 comprising an upper head tube opening 14 configured to accommodate a sprinkler 46, such as a sprinkler extending from a ceiling surface 48, and the lower head tube 16 is configured to accommodate a vacuum hose 44, such that the vacuum hose 44 removably attaches to the cleaning extension head 10.

As shown in FIGS. 1-4, some embodiments of the cleaning extension head 10 comprise a cap 24 configured to secure the vacuum hose 44 within the lower head tube 16 of the cleaning extension head 10. For example, a surface of the lower head tube 14 distal from the upper head tube 12 may comprise lower tube threads 20, which may be configured to engage with cap threads 26 located on an inner surface of the cap 24, wherein a gasket 22 may be positioned within the cap 24 to help secure the vacuum hose 44 within the cap 24, which is attached to the lower head tube 16.

Figure 5:
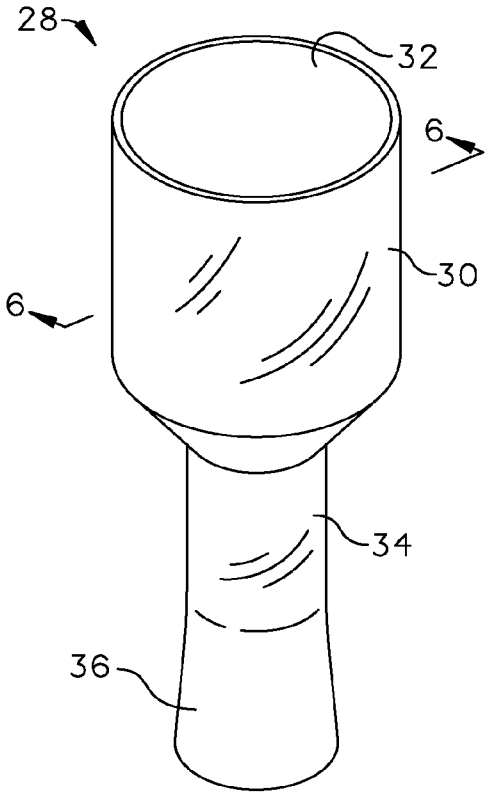
FIG. 5 is a perspective view of one embodiment of the present invention.
Figure 6:
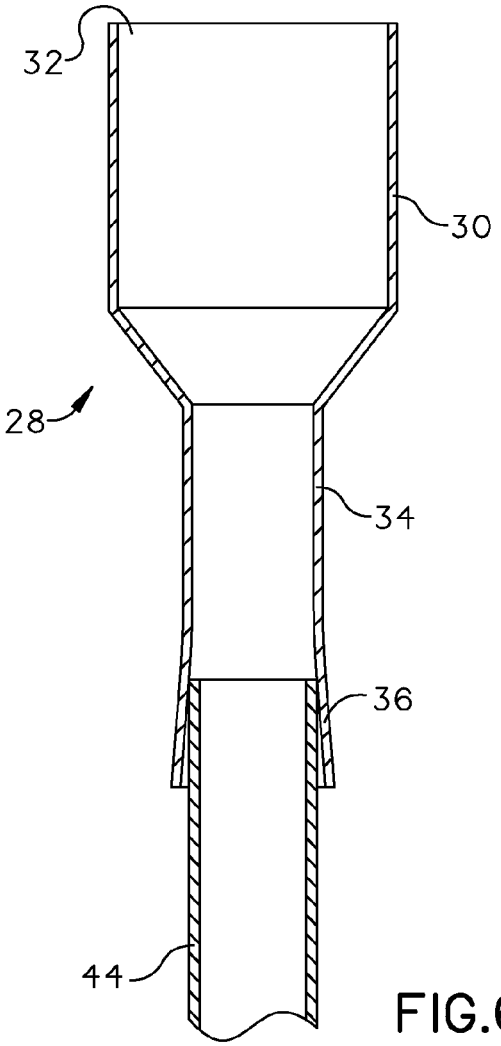
FIG. 6 is a section view of one embodiment of the present invention, taken along line 6-6 in FIG. 5.

Alternatively, as shown in FIGS. 5 and 6, an alternate cleaning extension head 28, which is similar in shape to the cleaning extension head 10 shown in FIGS. 1-4, may comprise an alternate upper head tube 30 that tapers to an alternate lower head tube, wherein the alternate lower head tube comprises a narrow lower tube section 34 proximate to the alternate upper head tube 30. The narrow lower tube section 34 may taper into a flared lower tube section 36, wherein the end of the flared lower tube section 36 distal from the alternate upper head tube 30 has a larger diameter than the narrow lower tube section 34, and wherein the flared lower tube section 36 is configured to accommodate a vacuum hose 44. Thus, in this embodiment, a cap 24 may not be necessary to attach the alternate cleaning head 28 to the vacuum hose 44. In such an embodiment, the alternate upper head tube 30 may have a larger diameter than both the narrow lower tube section 34 and the flared lower tube section 36, as shown in FIGS. 5 and 6.

Figure 7:
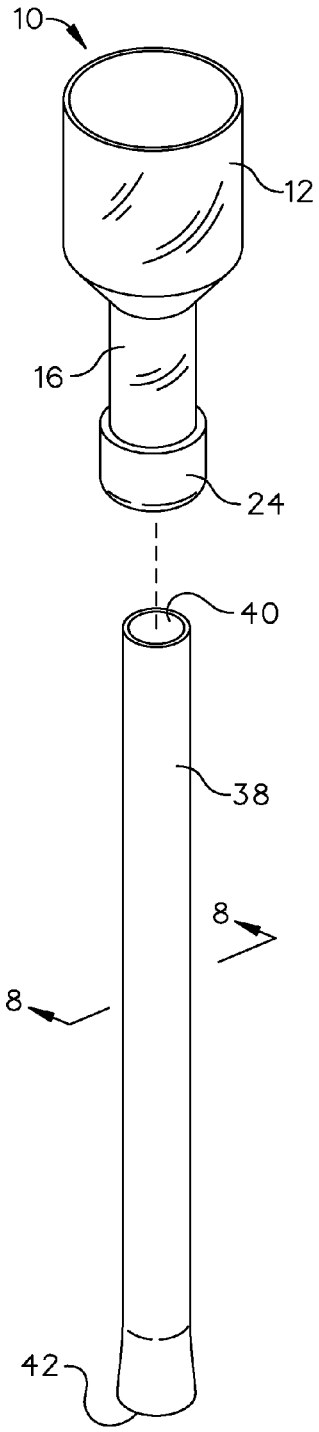
FIG. 7 is an exploded view of one embodiment of the present invention.
Figure 8:
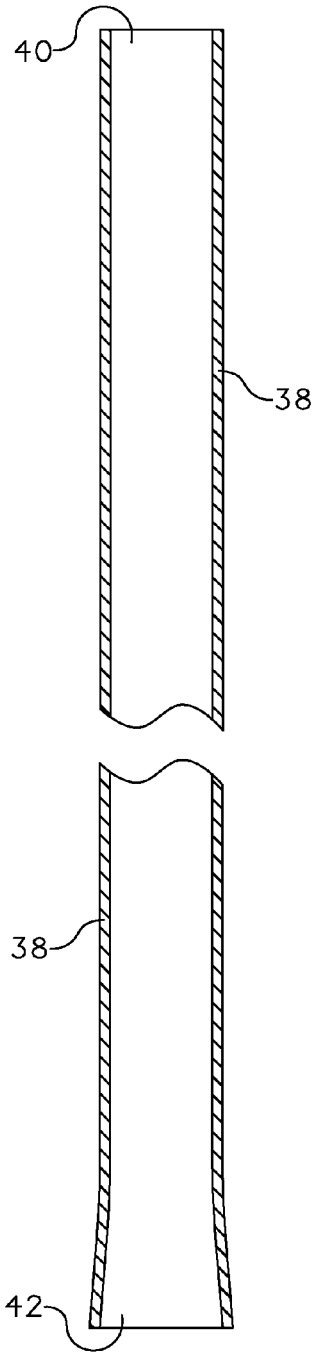
FIG. 8 is a section view of one embodiment of the present invention, taken along line 8-8 in FIG. 7.
Figure 9:
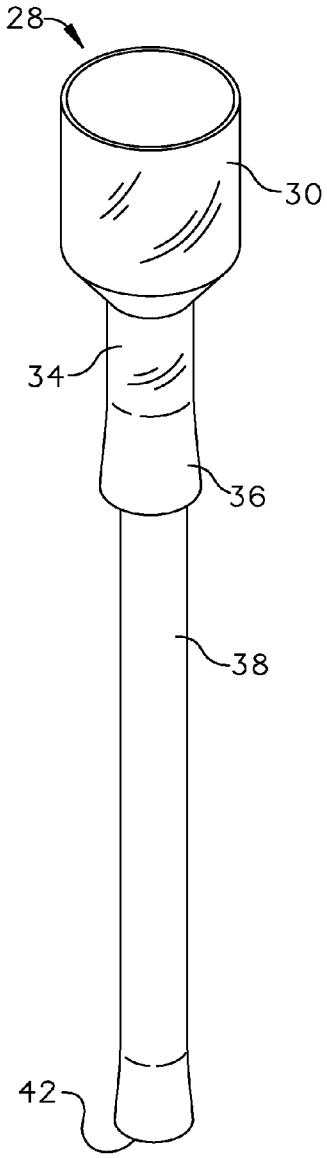
FIG. 9 is a perspective view of one embodiment of the present invention.

In either of the above described embodiments, the vacuum attachment may include a universal extension device 38 attached between the vacuum hose 44 and the cleaning extension head 10, 28. The universal extension device 38 may have a narrow opening 40 configured to engage with the cleaning extension head 10 and a wider opening 42 distal form the cleaning extension head 10, the wider opening 42 being configured to engage with a vacuum hose 44, as shown in FIGS. 7-9.

The vacuum attachment of the present disclosure may be used by attaching the vacuum attachment to a vacuum hose, placing the upper head tube opening 14 around a sprinkler head 46, and turn on the vacuum, wherein the vacuum attachment may leave enough space to safely suction dust, cobwebs, and other grime away from the sprinkler head 46 without breaking the sprinkler bulb.

The vacuum attachment may be made of any suitable material and, in some embodiments, comprises a plastic material. For example, the vacuum attachment may comprise a transparent plastic material so that a user can view the sprinkler head 46 through the upper head tube 12, 30 of the vacuum attachment. The upper head tube 12, 30 may have an upper head tube opening 14 with a diameter large enough to accommodate a sprinkler head 46, including sprinkler heads having a head cover, such as a plastic head cover. The lower head tube may have a diameter sufficiently to accommodate a vacuum hose 44 therein, wherein the vacuum hose 44 may fit snugly within the lower head tube. Thus, the lower head tube's opening may vary in diameter depending on the size of the vacuum hose being used therewith.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A vacuum attachment for cleaning sprinkler heads, the vacuum attachment comprising:
- a cleaning extension head comprising a hollow upper head tube tapering to a hollow lower head tube,
- wherein:
  - the upper head tube has a larger diameter than the lower head tube;
  - the upper head tube comprises an upper head tube opening configured to accommodate a facility sprinkler; and
  - the lower head tube is configured to accommodate a vacuum hose, such that the vacuum hose is configured to removably attach to the cleaning extension head;
- a universal extension device comprising:
  - a hollow tube removably attached to a lower tube opening in the lower head tube; and
  - a narrow opening configured to engage with the cleaning extension head and a wider opening distal form the cleaning extension head, the wider opening being configured to engage with the vacuum hose;
- wherein the universal extension device is configured to accommodate the vacuum hose.

2. The vacuum attachment of claim 1, further comprising a cap removably attached to the lower head tube, the cap being configured to secure the vacuum hose within the lower head tube.

3. The vacuum attachment of claim 2, wherein a surface of the lower head tube distal from the upper head tube comprises lower tube threads, which are configured to engage with cap threads located on an inner surface of the cap, such that the cap is configured to screw onto the lower head tube.

4. The vacuum attachment of claim 3, further comprising a gasket positioned within the cap to help secure the vacuum hose within the cap.

5. The vacuum attachment of claim 1, wherein
- the lower head tube comprises:
  - a narrow lower tube section proximate to the upper head tube; and
  - a flared lower tube section distal from the upper head tube and tapering from the narrow lower tube section
- wherein:
  - an end of the flared lower tube section distal from the upper head tube has a larger diameter than the narrow lower tube section; and
  - the flared lower tube section is configured to accommodate a vacuum hose.

6. The vacuum attachment of claim 5, wherein the upper head tube has a larger diameter than both the narrow lower tube section and the flared lower tube section.

7. A vacuum attachment for cleaning sprinkler heads, the vacuum attachment comprising:
- a cleaning extension head comprising a hollow upper head tube tapering to a hollow lower head tube;
- a universal extension device comprising a hollow tube removably attached to a lower tube opening in the lower head tube; and
- a cap removably attached to the lower head tube, the cap being configured to secure the vacuum hose within the lower head tube,
- wherein:
  - the upper head tube has a larger diameter than the lower head tube;
  - the upper head tube comprises an upper head tube opening configured to accommodate a facility sprinkler;
  - the lower head tube is configured to accommodate the universal extension device;
  - the universal extension device is configured to accommodate a vacuum hose; and
  - the universal extension device comprises a narrow opening configured to engage with the cleaning extension head and a wider opening distal form the cleaning extension head, the wider opening being configured to engage with the vacuum hose.

8. The vacuum attachment of claim 7, wherein a surface of the lower head tube distal from the upper head tube comprises lower tube threads, which are configured to engage with cap threads located on an inner surface of the cap, such that the cap is configured to screw onto the lower head tube.

9. The vacuum attachment of claim 8, further comprising a gasket positioned within the cap to help secure the vacuum hose within the cap.

10. The vacuum attachment of claim 7, wherein
- the lower head tube comprises:
  - a narrow lower tube section proximate to the upper head tube; and
  - a flared lower tube section distal from the upper head tube and tapering from the narrow lower tube section
- wherein:

an end of the flared lower tube section distal from the upper head tube has a larger diameter than the narrow lower tube section; and the flared lower tube section is configured to accommodate a vacuum hose.

11. The vacuum attachment of claim 10, wherein the upper head tube has a larger diameter than both the narrow lower tube section and the flared lower tube section.

* * * * *